US006927362B2

(12) United States Patent
Haluschka et al.

(10) Patent No.: US 6,927,362 B2
(45) Date of Patent: Aug. 9, 2005

(54) SHEATH TYPE GLOWPLUG WITH ION CURRENT SENSOR AND METHOD FOR OPERATION THEREOF

(75) Inventors: Christoph Haluschka, Klingenberg (DE); Juergen Arnold, Benningen (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 49 days.

(21) Appl. No.: 10/088,933

(22) PCT Filed: Apr. 14, 2001

(86) PCT No.: PCT/DE01/01470

§ 371 (c)(1),
(2), (4) Date: Jul. 17, 2002

(87) PCT Pub. No.: WO02/02933

PCT Pub. Date: Jan. 10, 2002

(65) Prior Publication Data

US 2003/0029855 A1 Feb. 13, 2003

(30) Foreign Application Priority Data

Jun. 30, 2000 (DE) ..... 100 31 893

(51) Int. Cl.[7] ..... F23Q 7/22

(52) U.S. Cl. ..... 219/270; 219/544; 123/145 A; 123/145 R; 361/265; 361/266

(58) Field of Search ..... 219/220, 267, 219/270, 544; 123/145 A, 145 R; 361/264–266

(56) References Cited

U.S. PATENT DOCUMENTS 6,483,079 B2 * 11/2002 Sato et al. ..... 219/270

FOREIGN PATENT DOCUMENTS

| | | |
|---|---|---|
| DE | 34 28 377 | 2/1986 |
| EP | 0 353 196 | 1/1990 |
| EP | 0 834 652 | 4/1998 |

* cited by examiner

*Primary Examiner*—Robin O. Evans
*Assistant Examiner*—Vinod Patel
(74) *Attorney, Agent, or Firm*—Kenyon & Kenyon

(57) ABSTRACT

A sheathed element glow plug having an ionic current sensor and a method of operating such a sheathed element glow plug are provided. The sheathed element glow plug includes a housing and a rod-shaped heating element arranged in a concentric bore in the housing. The heating element has at least one insulation layer, a first feeder layer, and a second feeder layer, the first feeder layer and the second feeder layer being connected by a web on the combustion chamber-side end of the heating element, the first and second feeder layers and the web being made of an electrically conducting ceramic material, and the insulation layer being made of an electrically insulating ceramic material. The heating element has at least one ionic current detection electrode made of an electrically conducting ceramic material.

12 Claims, 3 Drawing Sheets

SHEATH TYPE GLOWPLUG WITH ION CURRENT SENSOR AND METHOD FOR OPERATION THEREOF

FIELD OF THE INVENTION

The present invention relates to a ceramic sheathed element glow plug for diesel engines having an ionic current sensor. German Published Patent Application No. 34 28 371 describes ceramic sheathed element glow plugs having a ceramic heating element. The ceramic heating element has an electrode made of a metallic material which is used to determine the electric conductivity of the ionized gas present in the combustion chamber of the internal combustion engine. The wall of the combustion chamber functions as the second electrode.

In addition, there are also conventional sheathed element glow plugs having a housing in which is situated a rod-shaped heating element in a concentric bore. The heating element here is composed of at least one insulation layer and a first feeder layer and a second feeder layer, the first and second feeder layers being connected by a web at the tip of the heating element on the combustion chamber end. The insulation layer is made of an electrically insulating ceramic material, and the first and second feeder layers as well as the web are made of an electrically conducting ceramic material.

SUMMARY OF THE INVENTION

A ceramic sheathed element glow plug according to the present invention having the ionic current sensor may include a very simple design and may be inexpensive to manufacture. Furthermore, the expansion coefficients of the individual layers may be matched to one another.

Advantageous refinements of and improvements on the sheathed element glow plug having the ionic current sensor may be possible. According to one example embodiment of the sheathed element glow plug, the feeder layers may function as an electrode for detecting an ionic current. Electric terminals of the feeder layers may be provided on the end of the heating element remote from the combustion chamber so that operation of the sheathed element glow plug as an ionic current sensor may become possible. Additionally an ionic current detection electrode may be provided which runs inside the insulation layer or is applied to the insulation layer because in this manner glow operation and ionic current measurement may occur simultaneously. The ionic current detection electrode may be arranged laterally on the surface on the combustion chamber-side end of the heating element to thus ensure a sufficient distance between the feeder layer and the ionic current detection electrode. The ionic current detection electrode may continue to the end of the heating element on the combustion chamber side, because in this manner it may be possible to detect an ionic current in an area of the combustion chamber which may be important for the combustion processes occurring in the combustion chamber. Furthermore, a ceramic composite structure (described below) may be used for the various layers of the heating element whose conductivity and expansion coefficient may be adaptable. This may likewise be true of the precursor composite materials described below.

The sheathed element glow plug having the ionic current sensor may be operated according to different methods. Ionic current detection may occur, for example, in a different time window than the glow phase, because this may permit accurate ionic current detection. The ionic current detection may occur during the glow phase of the heating element, because it may be desirable to also detect the combustion process in the startup phase of the internal combustion engine.

DETAILED DESCRIPTION

Figure 1:
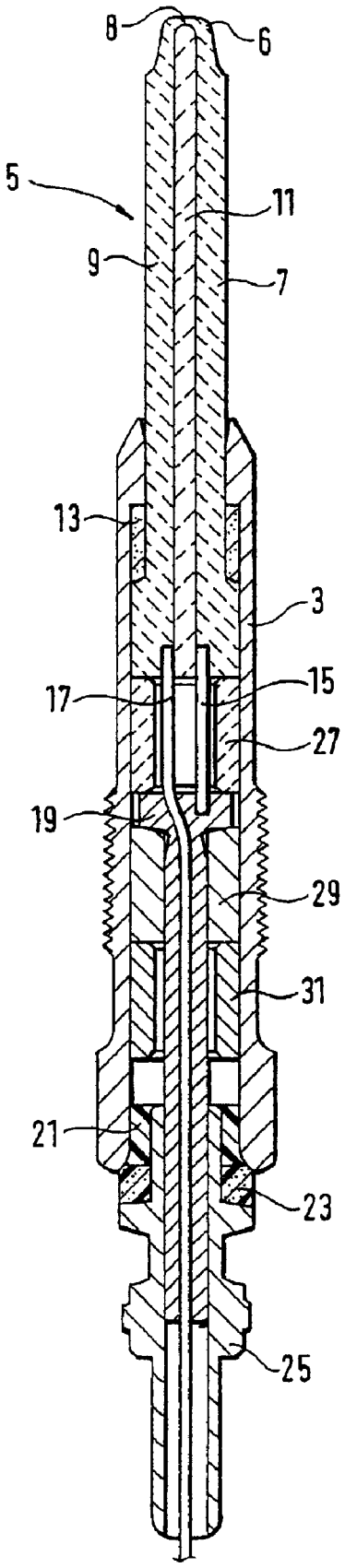
FIG. 1 is a schematic diagram of an example embodiment of a sheathed element glow plug according to the present invention having an ionic current sensor in a longitudinal section.

FIG. 1 is a schematic diagram of a longitudinal section through a sheathed element glow plug according to an example embodiment the present invention. A tubular housing 3, which may be, for example, made of metal, holds a heating element 5 in its concentric bore on the combustion chamber-side end. Heating element 5 is made of a ceramic material. Heating element 5 has a first feeder layer 7 and a second feeder layer 9, first feeder layer 7 and second feeder layer 9 being made of an electrically conducting ceramic material. On end 6 of the heating element remote from the combustion chamber, first feeder layer 7 and second feeder layer 9 are connected by a web 8 which is also made of an electrically conducting ceramic material. First feeder layer 7 and second feeder layer 9 are separated by an insulation layer 1. Insulation layer 11 is made of an electrically insulating ceramic material. The interior of housing 3 is sealed in the direction of the combustion chamber by a combustion chamber seal 13 surrounding heating element 5 in a ring. On the end of heating element 5 remote from the combustion chamber, first feeder layer 7 is connected to a first terminal 15. This first terminal 15 is in turn connected to terminal stud 19 in the direction of the end of the sheathed element glow plug remote from the combustion chamber. Second feeder layer 9 is connected at its end remote from the combustion chamber to a second terminal 17 which passes through terminal stud 19 and continues to the end of the sheathed element glow plug remote from the combustion chamber, second terminal 17 being electrically insulated from the terminal stud. Terminal stud 19 is kept at a distance from the end of heating element 5 remote from the combustion chamber by a ceramic spacer sleeve 27 situated in the concentric bore of housing 3. In the direction of the end remote from the combustion chamber, terminal stud 19 passes through a tension sleeve 29 and a metal sleeve 31. On the end of the sheathed element glow plug remote from the combustion chamber, a round plug 25 is attached to terminal stud 19, establishing the electric connection. The end of the concentric bore of housing 3 remote from the combustion chamber is sealed and electrically insulated by a hose ring 21 and an insulation disc 23.

In this example embodiment the sheathed element glow plug may be operated so that the sheathed element glow plug is first operated in the heating mode in starting up the internal combustion engine. This means that during the glow phase, a positive voltage is applied to first terminal 15 and a negative voltage is applied to second terminal 17 or vice versa, so that a current flows across first feeder layer 17, web 8 and second feeder layer 9. The electric resistance along this path raises the temperature of the heating element and the combustion chamber into which the end of the sheathed element glow plug on the combustion chamber side protrudes, and thus the plug is heated. Heating element 5 is glazed on its end remote from the combustion chamber beyond the combustion chamber edge of housing 3, so that there is no electric contact between first or second feeder layers and housing 3.

After the end of the glow phase, the same high voltage potential is applied to first terminal 15 and second terminal 17 so that no more current flows in the feeder layers, but first feeder layer 7 and second feeder layer 9 function as the ionic current measurement electrode. If the combustion chamber is ionized by the presence of ions, an ionic current may flow from the ionic current detection electrode, i.e., from first feeder layer 7 and second feeder layer 9, to the wall of the combustion chamber which is at ground. Thus in this example embodiment, first feeder layer 7 and second feeder layer 9 function as an ionic current detection electrode.

Figure 2:
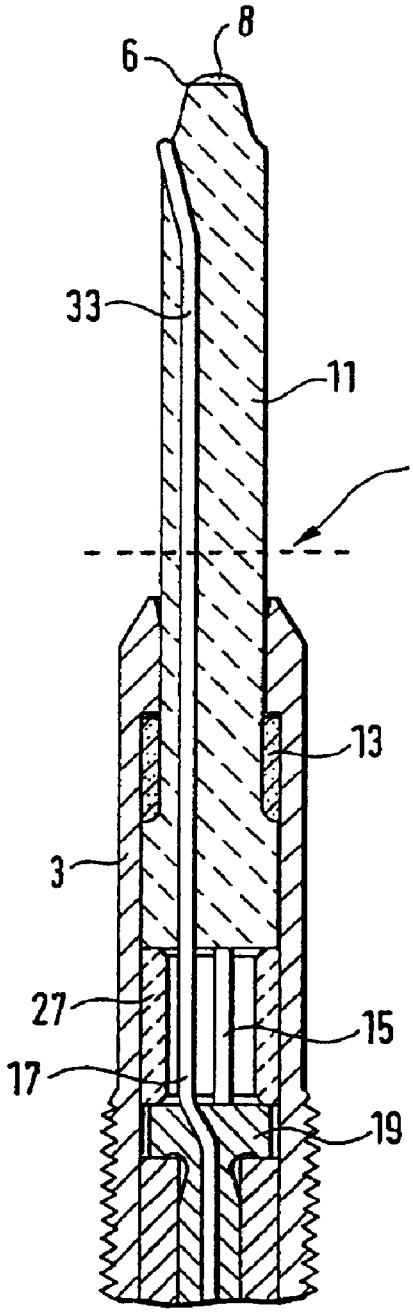
FIG. 2 is a schematic diagram of an example embodiment of a combustion chamber-side end of a sheathed element glow plug according to the present invention having an ionic current sensor in a longitudinal section.

FIG. 2 illustrates schematically another example embodiment of a sheathed element glow plug according to the present invention having an ionic current sensor in a longitudinal section. In this case only the combustion chamber-side end of such a sheathed element glow plug is illustrated. The end of this sheathed element glow plug remote from the combustion chamber corresponds to the configuration in the example embodiment illustrated in FIG. 1. Heating element 5 is again arranged in a concentric bore in housing 3, which may be made of metal. Heating element 5 is again composed of a first feeder layer 7, a second feeder layer 9 and an insulation layer 11, the cross section of heating element 5 illustrated in this diagram being cut in a plane so that only insulation layer 11 is visible (this plane is perpendicular to the section plane of FIG. 1). Insulation layer 11 and first feeder layer 7, web 8 and second feeder layer 9 are again made of materials which were already mentioned in conjunction with FIG. 1. First feeder layer 7 is connected to a terminal stud 19 by a first terminal 15. Terminal stud 19 is again kept at a distance from the end of the heating element which is remote from the combustion chamber by a ceramic spacer sleeve 27. The combustion chamber-side sealing of the interior of metallic housing 3 is again accomplished by a combustion chamber seal 13, which, in this example embodiment, is made of an electrically conducting material because the second feeder layer is connected to ground via combustion chamber seal 13 to housing 3. A glazing applied on the outside to the surface of the first feeder layer in the area of housing 3 and combustion chamber seal 13 prevents first feeder layer 7 from contacting combustion chamber seal 13 and housing 3.

In this example embodiment, an ionic current detection electrode 33, running from the end of heating element 5 remote from the combustion chamber to tip 6 of heating element 5 near the combustion chamber, is provided in insulation layer 11. Ionic current detection electrode 33 runs laterally on the surface of heating element 5 at tip 6 on the combustion chamber side. Ionic current detection electrode 33 is made of an electrically conducting ceramic material or a metallic material. The end of the ionic current detection electrode which is remote from the combustion chamber is connected to a second terminal 17 which runs through terminal stud 19 to the end of the sheathed element glow plug remote from the combustion chamber.

Figure 3:
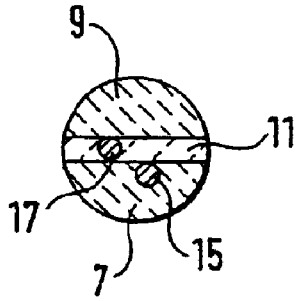
FIG. 3 is a schematic diagram of an example embodiment of a heating element of a sheathed element glow plug according to the present invention having an ionic current sensor in cross section.

FIG. 3 illustrates a cross section through heating element 5, illustrating the arrangement of terminals in the individual layers of the heating element again in detail. The cross section shows an area on the end of heating element 5 remote from the combustion chamber. First terminal 15 is connected to first feeder layer 7 while second terminal 17 is connected to the ionic current detection electrode which runs through insulation layer 11. In addition, second feeder layer 9 which has electric contact via electrically conducting combustion chamber seal 13 to housing 3, which is at ground, is also illustrated in an area situated further in the direction of the combustion chamber.

In this example embodiment, the sheathed element glow plug may be operated in glow operation and as an ionic current detection device simultaneously. To do so, the voltage required for glow operation is applied to first feeder layer 7 via terminal stud 19 and first terminal 15, and the voltage required for ionic current detection is applied to ionic current detection electrode 33 via second terminal 17.

Figure 4:
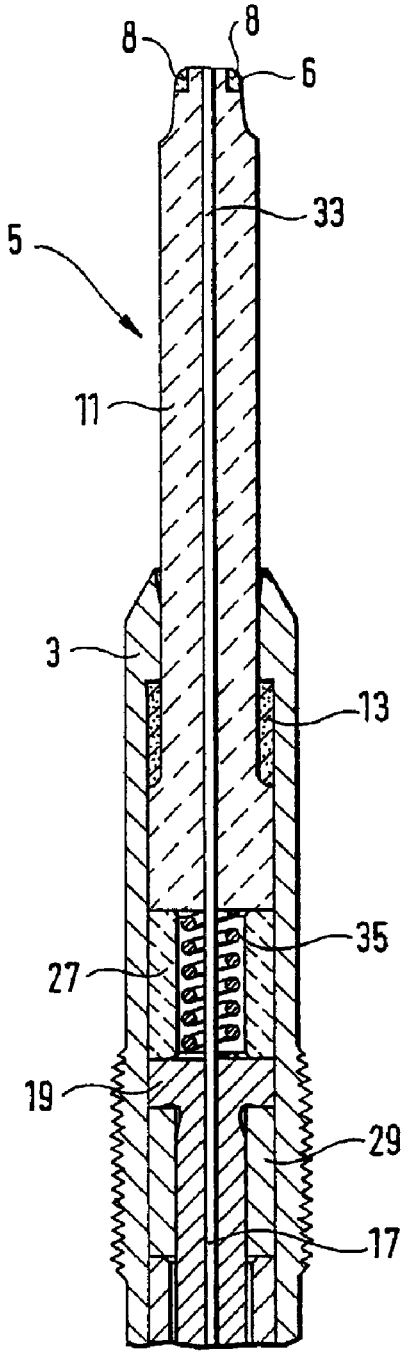
FIG. 4 is a schematic diagram of an end remote from the combustion chamber in another example embodiment of the sheathed element glow plug according to the present invention having an ionic current sensor in longitudinal section.

FIG. 4 illustrates another example embodiment of a sheathed element glow plug having an ionic current sensor. By analogy with FIG. 3, the combustion chamber-side end of such a sheathed element glow plug is illustrated schematically in a longitudinal section. Heating element 5 is also illustrated sectioned in a plane in which only insulation 11 is visible, as in FIG. 2. The same reference numbers in this figure and in the following figures denote the same parts as in the preceding figures; therefore, they will not be discussed again here.

An ionic current detection electrode 33 again passes through the insulation Layer, but this electrode extends to the outermost combustion chamber-side tip 13 of heating element S. In contrast with the example embodiment illustrated in FIG. 2, the electrode does not continue laterally beyond the surface of the heating element. Since ionic current detection electrode 33 now passes centrally through insulation layer 11, the connection to first terminal 17 is also centrally situated. In an example embodiment, first terminal 17 passes through a spring element 35 situated in a concentric bore in spacer sleeve 27, which may be insulated from spring element 35, and continuing through terminal 19 in the direction of the end of the sheathed element glow plug remote from the combustion chamber. Spring element 35 makes it possible to apply pressure to heating element 5 or terminal stud 19 and establishes the electric contact with first feeder layer 7, so that optimal electric contact and optimal sealing of the interior of housing 3 from the environment may be achieved by combustion chamber seal 13. The interior of housing 3 is sealed via spacer sleeve 27. The electric contact of second feeder layer 9 is configured like that in the embodiment described on the basis of FIG. 2.

In another example embodiment, the terminals remote from the combustion chamber on first feeder layer 7 and on ionic current detection electrode 33 may also be configured without spring element 35 by analogy with FIG. 2.

Figure 5:
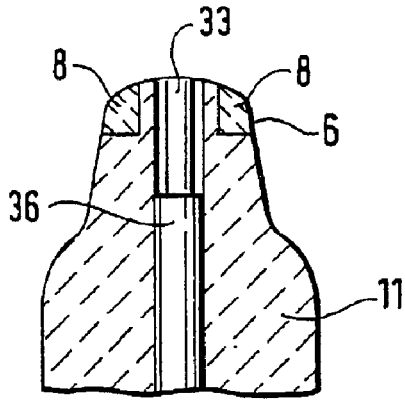
FIGS. 5 and 6 each illustrate a schematic longitudinal section through a combustion chamber-side end of a heating element of a sheathed element glow plug according to the present invention having an ionic current sensor.
Figure 6:
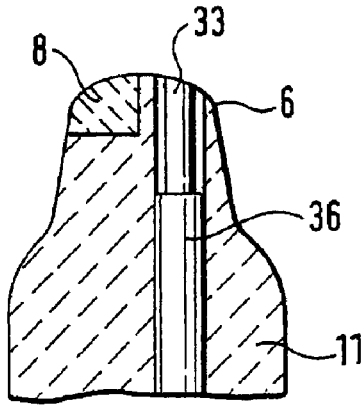

On the basis of FIGS. 5 and 6, various example embodiments of the configuration of combustion chamber-side tip 6 of heating element 5 are depicted for the example embodiment illustrated in FIG. 4. Each illustrates a longitudinal section through the combustion chamber-side tip of heating element 5.

FIG. 5 illustrates ionic current detection electrode 33 which runs to the combustion chamber-side tip of heating element 5 within insulation layer 11, which extends to combustion chamber-side tip 6 of heating element 5. First feeder layer 7 and second feeder layer 9 are connected by web 8 in only two areas, which are arranged at a distance from the area in which ionic current detection electrode 33 extends up to combustion chamber-side tip 6 of the heating element 8 in the radial direction (with respect to the longitudinal axis through heating element 5, i.e., through the sheathed element glow plug). FIG. 5 also illustrates that in an example embodiment, the ionic current detection electrode may be arranged in an insulation sleeve 36 which extends almost to the combustion chamber-side end of the sheathed element glow plug.

FIG. 6 shows another example embodiment in which ionic current detection electrode 33 continues laterally to combustion chamber-side tip 6 of heating element 5, and combustion chamber-side end 6 of heating element 5 has only one area in which first feeder layer 7 and second feeder layer 9 are connected by a web 8. The area in which web 8 is configured in this example embodiment is arranged on the side of combustion chamber-side tip 6 of heating element 5 which does not have ionic current detection electrode 33. In this example embodiment, the sheathed element glow plug may be arranged in the combustion chamber, so that the side of combustion chamber-side tip 6 of heating element 5 on which web 8 is configured projects the greatest distance into the combustion chamber. This may be taken into account in particular in an arrangement when the sheathed element glow plug projects obliquely into the combustion chamber.

The example embodiment illustrated on the basis of FIGS. 4, 5 and 6 may includes an ionic current detection electrode made of an electrically conducting ceramic material.

In another variant of the example embodiments illustrated on the basis of FIGS. 2 through 6, ionic current detection electrode 33 may also be applied externally to insulation layer 11.

As mentioned above, the materials of first feeder layer 7, web 8, second feeder layer 9, insulation layer 11 and ionic current detection electrode 33 may be made of a ceramic material. This may ensure that the thermal expansion coefficients of the materials may hardly differ at all, thus virtually guaranteeing the long-term stability of heating element 5. The material of first feeder layer 7, web 8 and second feeder layer 9 is selected so that the resistance of these layers is less than the resistance of insulation layer 11. Likewise, the resistance of first ionic current detection electrode 33 is less than the resistance of insulation layer 11.

In an example embodiment, first feeder layer 7, web 8 and second feeder layer 9, insulation layer 11 and first electrode 33 are made of ceramic composite structures containing at least two of the compounds $Al_2O_3$, $MoSi_2$, $Si_3N_4$ and $Y_2O_3$. These composite structures are obtainable by a sintering operation in one or two steps. The specific resistance of the layers may be determined, for example, on the basis of the $MoSi_2$ content and/or the core size of $MoSi_2$, the $MoSi_2$ content of first feeder layer 7, web 8 and second feeder layer 9 as well as first ionic current detection electrode 33 may be higher than the $MoSi_2$ content of insulation layer 11.

In example another embodiment, first feeder layer 7, web 8 and second feeder layer 9, insulation layer 11, and first ionic current detection electrode 33 are made of a precursor ceramic having different filler contents. The matrix of this material includes polysiloxanes, polysilsesquioxanes, polysilanes or polysilazahes which may be doped with boron, nitrogen or aluminum and are produced by pyrolysis. At least one of the compounds $Al_2O_3$, $MoSi_2$, $SiO_2$, and SiC forms the filler for the individual layers. By analogy with the composite structure described above, the $MoSi_2$ content and/or the grain size of $MoSi_2$ may determine the resistance of the layers. The $MoSi_2$ content of first feeder layer 7, web 8 and second feeder layer 9 as well as first ionic current detection electrode 33 may be higher than the $MoSi_2$ content of insulation layer 11. In the example embodiments described above, the compositions of first feeder layer 7, web 8, second feeder layer 9, insulation layer 11 and first ionic current detection electrode 33 are selected so that their thermal expansion coefficients and the shrinkage that may occur during the sintering and pyrolysis process are the same, so that no cracks develop in heating element 5.

What is claimed is:

1. A sheathed element glow plug having an ionic current sensor, comprising:

a housing having a concentric bore; and a rod-shaped heating element arranged in the concentric bore, the heating element including at least one insulation layer, a first feeder layer, a second feeder layer, and a web, the first feeder layer and the second feeder layer connected by the web on a combustion chamber-side end of the heating element, the first and second feeder layers and the web made of an electrically conducting ceramic material, the insulation layer made of an electrically insulating ceramic material, wherein (a) the heating element includes a single ionic current detection electrode made of an electrically conducting ceramic material and not connected to the first and second feeder layers; and (b) the first and second feeder layers are arranged to operate as ionic current detection electrodes, an electrical voltage having a same voltage potential being applied to the first and second feeder layers for ionic current detection.

2. The sheathed element glow plug according to claim 1, further comprising a first electric terminal and a second electric terminal arranged on an end of the heating element remote from a combustion chamber, the first electric terminal connected to an end of the first feeder layer remote from the combustion chamber, the second electric terminal connected to an end of the second feeder layer remote from the combustion chamber.

3. The sheathed element glow plug according to claim 1, wherein the single ionic current detection electrode one of extends inside the insulation layer and is applied to the insulation layer.

4. The sheathed element glow plug according to claim 3, wherein the single ionic current detection electrode extends laterally on a surface of the heating element in a direction remote from a combustion chamber in front of an area in which the first and second feeder layers are connected to the combustion chamber-side end of the heating element.

5. The sheathed element glow plug according to claim 3, wherein the single ionic current detection electrode extends inside the insulation layer to the combustion chamber-side end of the heating element, the insulation layer extending to the combustion chamber-side end of the heating element.

6. The sheathed element glow plug according to claim 3, further comprising:

a first electric terminal connected to the first feeder layer on an end remote from a combustion chamber; and a second electrical terminal connected to the single ionic current detection electrode on an end remote from the combustion chamber.

7. The sheathed element glow plug according to claim 3, wherein the second feeder layer is connected to a ground via the housing.

8. The sheathed element glow plug according to claim 1, further comprising a tubular spacer sleeve made of an electrically insulating material arranged within the concentric bore on an end of the heating element remote from a combustion chamber.

9. The sheathed element glow plug according to claim 1, wherein the insulation layer, the first feeder layer, the web, the second feeder layer and the single ionic current detection electrode include ceramic composite structures accessible by a sintering operation in at least one step using at least two of $Al_2O_3$, $MoSi_2$, $Si_3N_4$ and $Y_2O_3$.

10. The sheathed element glow plug according to claim 1, wherein the insulation layer, the web, the first feeder layer, the second feeder layer and the single ionic current detection electrode include a composite precursor ceramic having a matrix material including one of polysiloxanes, polysilsesquioxanes, polysilanes, and polysilazanes, which are dopable with one of boron, nitrogen, and aluminum and are produced by pyrolysis, a filler of the matrix material formed from at least one of $Al_2O_3$, $MoSi_2$, $SiO_2$ and SiC.

11. A method of operating a sheathed element glow plug having an ionic current sensor, the glow plug including a housing having a concentric bore and a rod-shaped heating element arranged in the concentric bore, the heating element including at least one insulation layer, a first feeder layer, a second feeder layer, and a web, the first feeder layer and the second feeder layer connected by the web on a combustion chamber-side end of the heating element, the first and second feeder layers and the web made of an electrically conducting ceramic material, the insulation layer made of an electrically insulating ceramic material, the heating element including at least one ionic current detection electrode made of an electrically conducting ceramic material and not connected to the first and second feeder layers, comprising the steps of:

applying, during a glow phase, a first electric voltage to the first feeder layer and a second electric voltage to the second feeder layer, a voltage potential of the first electric voltage different from a voltage potential of the second electric voltage; and applying, after an end of the glow phase, a third electrical voltage having a same voltage potential to the first and second feeder layers for ionic current detection.

12. A method of operating a sheathed element glow plug having an ionic current sensor, the glow plug including a housing having a concentric bore and a rod-shaped heating element arranged in the concentric bore, the heating element including at least one insulation layer, a first feeder layer, a second feeder layer, and a web, the first feeder layer and the second feeder layer connected by the web on a combustion chamber-side end of the heating element, the first and second feeder layers and the web made of an electrically conducting ceramic material, the insulation layer made of an electrically insulating ceramic material, the heating element including a single ionic current detection electrode not connected to the first and second feeder layers made of an electrically conducting ceramic material, comprising the step of:

applying, during a glow phase, electric voltages having different voltage potentials to the first and second feeders and, at a same time, to the ionic current detection electrode.

* * * * *